United States Patent [19]

Häusler et al.

[11] Patent Number: 4,924,884

[45] Date of Patent: May 15, 1990

[54] METHOD OF AND APPARATUS FOR MAKING ROD-SHAPED ARTICLES OF THE TOBACCO PROCESSING INDUSTRY

[75] Inventors: Nikolaus Häusler, Wohltorf; Heidi Müller, Oststeinbek; Peter Pinck, Gross-Hansdorf; Christina Straube, Hamburg, all of Fed. Rep. of Germany

[73] Assignee: Körber AG, Hamburg, Fed. Rep. of Germany

[21] Appl. No.: 307,377

[22] Filed: Feb. 6, 1989

[30] Foreign Application Priority Data

Feb. 5, 1988 [DE] Fed. Rep. of Germany ..... 3803471

[51] Int. Cl.[5] ..... A24C 5/18; A24C 5/31; B31F 1/00

[52] U.S. Cl. ..... 131/84.1; 156/461; 493/34; 131/280

[58] Field of Search ..... 131/84.1, 84.3, 84.4, 131/903, 905, 906, 280, 902; 156/461; 493/34

[56] References Cited

U.S. PATENT DOCUMENTS 3,971,695 7/1976 Block ..... 156/461

*Primary Examiner*—V. Millin

*Attorney, Agent, or Firm*—Peter K. Kontler

[57] ABSTRACT

A continuous filter tow is advanced through a combined wrapping and condensing station by an endless belt, and the thickness of the belt decreases as a result of wear. The resistance which the condensed tow offers to the flow of air is measured by a pneumatic detector at the aforementioned station, and the accuracy of such measurement is affected by decreasing thickness of the belt as a result of increasing rate of escape of testing fluid along the belt. Therefore, the thickness of the belt is monitored and signals which are generated to denote the thickness of the belt are used to correct signals which are generated to denote the resistance to the flow of air. The correction involves modifying the signals denoting the resistance to the flow of air to denote a more pronounced resistance proportionally with decreasing thickness of the belt.

19 Claims, 1 Drawing Sheet

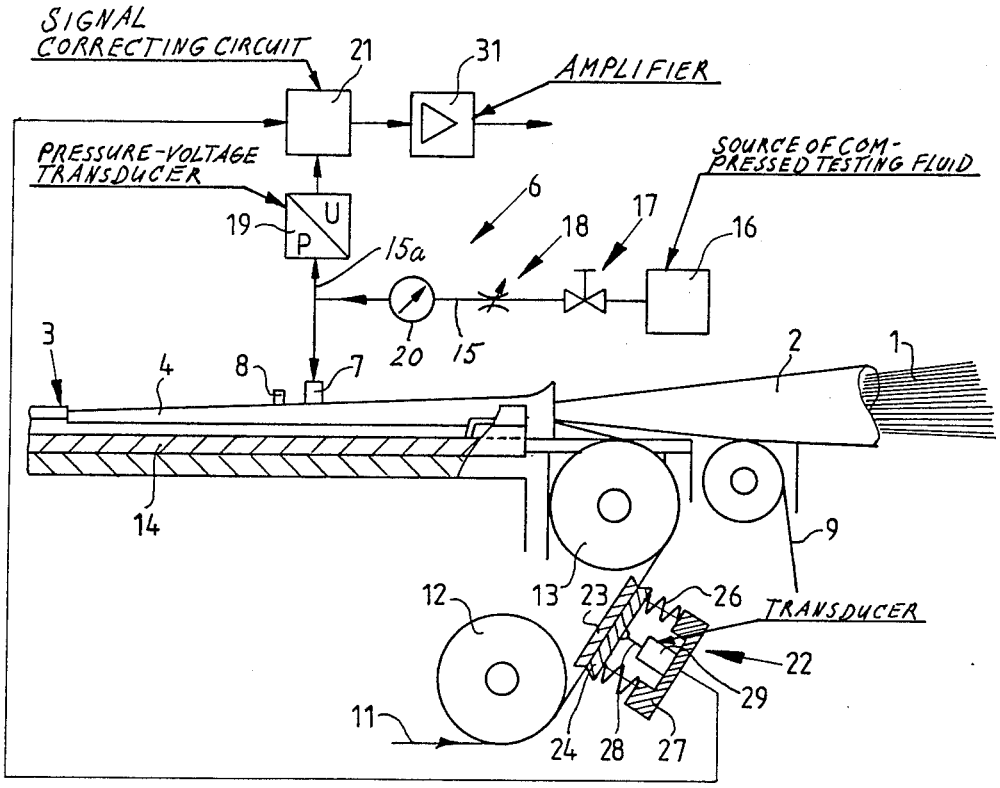
SIGNAL CORRECTING CIRCUIT
21
31
AMPLIFIER
PRESSURE-VOLTAGE TRANSDUCER
SOURCE OF COMPRESSED TESTING FLUID
6
17
18
16
19
U
P
15a
20
15
3
4
8
7
2
1
14
9
13
12
23
26
TRANSDUCER
22
29
11
24
28
27

METHOD OF AND APPARATUS FOR MAKING ROD-SHAPED ARTICLES OF THE TOBACCO PROCESSING INDUSTRY

BACKGROUND OF THE INVENTION

The invention relates to improvements in methods of and in apparatus for making rod-shaped articles of the tobacco processing industry. More particularly, the invention relates to improvements in methods of and in apparatus for making elongated rod-shaped bodies from continuous flows (such as streams or tows, hereinafter called tows) of fibrous material. Typical examples of rod-shaped bodies which can be produced in accordance with the method and apparatus of the present invention are filter rods which are to be subdivided into filter rod sections of unit length or multiple unit length for attachment to plain cigarettes, cigars or cigarillos.

It is well known to monitor the characteristics of elongated rod-shaped bodies which are to be subdivided into rod-shaped articles of the tobacco processing industry. For example, a continuous tobacco filler which is to be converted into a cigarette rod is normally monitored for density, and appropriate corrective undertakings are carried out if the density deviates from an acceptable range of densities. It is also known to ascertain the resistance which a tobacco filler or a filler of fibrous filter material offers to axial and/or transverse flow of air because this furnishes information concerning the resistance which is encountered by tobacco smoke during flow from the lighted end of a cigarette, cigar, cigarillo or cheroot toward and into the mouth of the smoker. Still further, it is known to pneumatically test coherent or discrete rod-shaped articles of the tobacco processing industry in order to ascertain the hardness of their fillers.

Irrespective of the exact nature of the testing operation, the results of the test or tests are used to indicate the monitored characteristic or characteristics and/or to adjust the apparatus in order to ensure that the characteristic or characteristics are altered when they depart from acceptable values. For example, pneumatic measurements of resistance which a rod of fibrous smoking or filter material offers to the flow of air therethrough can be used for the generation of signals which influence the operation of the rod making machine in a sense to ensure that the resistance of the ultimate product (such as filter rod sections or plain cigarettes) will match or closely approximate the optimum resistance.

Commonly owned U.S. Pat. No. 3,971,695 to Block discloses a method of and an apparatus for making filter plugs. The apparatus is equipped with a testing device which ascertains the resistance of filter plugs to axial flow of air therethrough. The patented apparatus is further equipped with means for ascertaining the resistance to the flow of air through the unwrapped filler of a filter rod and to regulate the quantity of filter tow in the rod in dependency on the results of the testing operation. The results of such testing operation can also be used to regulate the extent to which the filaments of the tow are stretched ahead of the compacting station and/or to regulate the rate of speed at which the filler is draped into a web of wrapping material.

A filter rod making machine employs an endless conveyor belt, also called garniture belt, which transports successive increments of the tow of fibrous filter material and a web of wrapping material through a combined compacting or condensing and wrapping station where the compacted tow and the web are converted into a continuous filter rod. The rod is thereupon subdivided into filter rod sections of unit length or multiple unit length, and such sections are introduced into a tipping machine which turns our filter cigarettes, cigarillos or cigars. It has been found that the conveyor belt is subject to extensive wear and that such wear influences the accuracy of pneumatic testing operation or operations which are carried out upon the tow or filler in the region where the tow or filler is transported by the belt. Thus, testing fluid is likely to escape from the wrapping mechanism at a rate which is directly related to the extent of wear upon the belt. This can distort the results of measurements and can entail inaccurate adjustments of the maker so that the characteristics (such as the resistance to flow of tobacco smoke) of ultimate products depart from acceptable characteristics. Uncontrolled escape of testing fluid can also influence the results of measurements which are carried out in order to ascertain the hardness of the filler in the region where the filler is transported by the belt.

OBJECTS OF THE INVENTION

An object of the invention is to provide a method which can be relied upon for accurate determination of one or more characteristics of tows or converted tows of fibrous material in a machine for making rod-shaped articles of the tobacco processing industry.

Another object of the invention is to provide a novel and improved method of accurately determining the rate of flow of a testing fluid through the fibrous material of a continuous tow in a rod making machine, particularly in a filter rod making machine.

A further object of the invention is to provide a method which ensures that the accuracy of testing is less affected by wear upon certain parts of the rod maker than in accordance with heretofore known methods.

An additional object of the invention is to provide a novel and improved method of accurately measuring the resistance which a compacted filler of fibrous material, particularly a compacted filler of fibrous filter material for tobacco smoke, offers to the flow of a testing fluid.

Still another object of the invention is to provide a novel and improved method of ascertaining the extent of wear upon certain expendable components of apparatus for making rod-shaped bodies of fibrous material.

A further object of the invention is to provide a novel and improved apparatus for the practice of the above outlined method.

Another object of the invention is to provide the apparatus with novel and improved means for reducing the effect of wear upon expendable component parts on the results of tests for determination of the hardness of rod-shaped bodies of fibrous material and/or of the rate of fluid flow through such bodies.

An additional object of the invention is to provide the apparatus with novel and improved means for monitoring the thickness of an endless conveyor belt which is used in rod making machines of the tobacco processing industry.

A further object of the invention is to provide a filter rod making machine which embodies the above outlined apparatus.

Another object of the invention is to provide a novel and improved control arrangement for use in the above outlined apparatus to influence the results of a first test by the results of a different second test.

SUMMARY OF THE INVENTION

One feature of the present invention resides in the provision of a continuous body of fibrous material, particularly for the purposes of subdivision of the body into rod-shaped articles of predetermined length (such as filter rod sections for attachment to plain cigarettes, cigars or cigarillos). The method comprises the steps of advancing a continuous tow of fibrous material along a predetermined path including transporting the tow by an endless belt the thickness of which decreases as a result of wear, gradually condensing the running tow in a predetermined portion of the path to thus convert the tow into a rod-like filler, measuring a characteristic of the filler and generating first signals denoting the measured characteristic, monitoring the thickness of the belt and generating second signals denoting the monitored thickness of the belt, and modifying the first signals as a function of second signals, particularly as a function of variations of second signals in response to decreasing thickness of the belt.

The measuring step can include measuring a characteristic of the filler in the predetermined portion of the path, particularly ascertaining the resistance which the filler offers to the flow of air or another gaseous fluid therethrough. The measurement can involve a determination of resistance which the filler offers to transverse flow and/or to axial flow of a fluid. The modifying step of such method can include correcting the first signals to denote a higher resistance to the flow of gaseous fluid in response to decreasing thickness of the belt.

The tow can contain a filamentary filter material, and the method can further comprise the step of draping the filler into a web of wrapping material (such as cigarette paper) to convert the web and the filler into a continuous filter rod. The draping step can be carried out in the predetermined portion of the path.

Another feature of the invention resides in the provision of an apparatus for making a continuous body of fibrous material (such as a filter rod), particularly for subdivision into rod-shaped articles of predetermined length. The improved apparatus comprises means for advancing a tow of fibrous material along a predetermined path including an endless belt the thickness of which decreases as a result of wear, means for gradually condensing the tow in a predetermined portion of the path to thus convert the tow into a rod-like filler, means for measuring a characteristic of the filler including means for generating first signals which denote the measured characteristic, means for monitoring the thickness of the belt including means for generating second signals which denote the monitored thickness of the belt, and means for modifying the first signals as a function of the second signals.

The measuring means can include means for measuring a characteristic in the predetermined portion of the path, and the belt preferably includes a portion which advances the fibrous material along such portion of the path.

The characteristic which is measured by the measuring means is preferably the resistance which the filler offer to the flow of air or another gaseous fluid therethrough, and the modifying means of such apparatus can comprise means for correcting the first signals to denote a higher resistance to the flow of a gaseous fluid in response to decreasing thickness of the belt.

The means for generating second signals can include a displacement measuring device (such as a capacitive or inductive detector), and the monitoring means including the displacement measuring device can include a first guide (such as a shoe) at one side of the belt and a mobile second guide at the other side of the belt opposite the first guide. The second guide is mounted for movement toward the first guide in response to decreasing thickness of the belt, and the displacement measuring device is arranged to generate second signals which vary in response to movement of the second guide toward the first guide. One or more coil springs and/or other suitable biasing means can be provided to yieldably urge the second guide toward the first guide.

The means for measuring the resistance which the filler offers to the flow of a gaseous fluid can include a source of pressurized fluid, and the condensing means can be provided with an inlet which is connected to the source and serves to direct a stream of gaseous fluid against fibrous material in the predetermined portion of the path.

As mentioned above, the apparatus can be designed for the making of a filter rod, and such apparatus then further comprises means for draping the filler into a web of wrapping material (such as cigarette paper). The draping means can include the belt and/or the condensing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary schematic partly elevational and partly longitudinal sectional view of a filter rod making machine including an apparatus which embodies one form of the present invention.

DESCRIPTION OF PREFERRED EMBODIMENTS

The drawing shows a portion of a filter rod making machine of the type fully described and shown in U.S. Pat. No. 3,971,695 to Block. The illustrated portion of the machine comprises a gathering horn 2 which receives a continuous tow or stream 1 of fibrous filter material from a tow processing unit wherein the tow is stretched and sprinkled with droplets of atomized plasticizer in a manner as shown, for example, in the right-hand portion of FIG. 1 in the patent to Block. The horn 2 admits successive increments of the tow 1 into a wrapping mechanism 3 wherein the tow is gradually compacted or densified by an elongated finger- or prong-like component 4 above a trough-shaped lower section 14 of the mechanism 3.

The component 4 has an inlet 7 for compressed air or another testing fluid, and an outlet 8 for spent testing fluid. The inlet 7 receives testing fluid from a conduit 15 forming part of a device 6 which measures the resistance of the compacted tow 1 (namely a rod-like filler of fibrous filter material) to axial flow of testing fluid from the inlet 7 to the outlet 8. The intake end of the conduit 15 is connected to a source 16 of compressed gaseous testing fluid, and this conduit contains a shutoff valve 17, a preferably adjustable flow restrictor 18 downstream of the valve 17, and a pressure gauge 20 downstream of the flow restrictor. A branch 15*a* of the conduit 15 discharges into a pressure-voltage transducer 19 having an output connected with one input of a signal correcting circuit 21.

The means for advancing the filler (compacted tow 1) and a continuous web 9 of cigarette paper or the like through that portion of the path of movement of the tow which is occupied by the wrapping mechanism 3 comprises an endless conveyor belt 11 (also called garniture belt) which is trained over pulleys 12, 13 and serves to drape the web 9 around the filler in the progressively concave channel at the upper side of the bottom section 14. One marginal portion of the web 9 is coated with a suitable adhesive and is folded over the other marginal portion to form an axially parallel seam of the resulting filter rod. The latter is thereupon caused to advance through a conventional cutoff which subdivides it into filter rod sections of unit length or multiple unit length. Such filter rod sections are ready for attachment to plain cigarettes, cigars or cigarillos in a tipping machine (e.g., a machine known as MAX which is distributed by the assignee of the present application).

In accordance with a feature of the invention, the apparatus further comprises a device 22 which monitors the thickness of the belt 11 and transmits corresponding signals to a second input of the signal correcting circuit 21. The device 22 comprises a fixedly mounted guide member 23 in the form of a shoe mounted at one side of the path of movement of the belt 11, a movable second guide member 24 in the form of a shoe which is mounted at the other side of the path of movement of the belt opposite the guide member 23 and is urged toward the member 23 by one or more coil springs 26 and/or other suitable biasing means, a fixed supporting plate 27, a distance measuring transducer 29 on the plate 27, and a motion transmitting element 28 which is coupled to the mobile guide member 24 and is operatively connected to the transducer 29. The springs 26 react against the plate 27. The transducer 29 is a capacitive or inductive distance detecting or monitoring component of any known design which is capable of responding to minute displacements of the guide member 24 toward the guide member 23 in order to generate signals which are indicative of the extent of wear upon the belt 11, i.e., of the rate at which the thickness of the belt 11 decreases, primarily as a result of rubbing against the concave surface of the trough-shaped bottom section 14 of the wrapping mechanism 3.

As a rule, the belt 11 (the useful life of which is normally not more than two consecutive shifts) undergoes maximum wear and pronounced reduction of thickness during the initial stage of its use, i.e., right after it is installed in the rod making machine to advance the tow 1 and the web 9 through the wrapping mechanism 3. As the wear upon the belt 11 increases, the rate of escape of testing fluid along the belt and out of the wrapping mechanism 3 also increases, i.e., the testing fluid leaves the mechanism 3 by a route other than via outlet 8. Therefore, and in the absence of any correction of signals which are generated by the transducer 19 of the axial flow measuring device 6, such signals would be misleading because they would fail to take into consideration leakage of testing fluid as a result of decreasing thickness of the belt 11.

The signal correcting circuit 21 modifies signals from the output of the transducer 19 as a function of signals from the transducer 29 in such a way that the signals at the output of the circuit 21 are indicative of greater resistance to the flow of testing fluid from the inlet 7 to the outlet 8 as the thickness of the belt 11 decreases. The thus corrected signals are transmitted to an amplifier 31 and the amplified signals are used to carry out corrective measures when the resistance to flow of testing fluid through the filler in the wrapping mechanism 3 departs from the range of acceptable resistances. The signals which are amplified at 31 can be displayed on a screen, not shown, used to alter the rate at which the filaments of the tow 1 are stretched ahead of the gathering horn 2 and/or used to alter the speed of the belt 11.

The illustrated thickness monitoring device 22 can be modified in a number of ways without departing from the spirit of the invention. For example, the guide member 23 can be replaced with a first idler roller which is rotatable about a fixed axis, and the guide member 24 can be replaced with a second idler roller which is mounted on a pivotable lever. The lever carries the motion transmitting element 28 or an analogous input element for the transducer 29 which generates signals denoting the extent of pivotal movement of the lever as a result of a reduction of the thickness of the belt 11. It is also possible to employ an ultrasonic or a pneumatic thickness monitoring device.

The device 6 can be replaced with or can constitute a device which measures the hardness of successive increments of the filler which is formed in the wrapping mechanism. All that counts is to ensure that the device 22 will be used to generate signals for modification of signals which are affected by progressively increasing rate of escape of testing fluid from the wrapping mechanism 3 as a result of progressing wear upon the belt 11.

The improved method and apparatus can be used with equal or similar advantage for correction of signals which are generated in a cigarette rod making machine of the type having means for pneumatically monitoring the hardness of a filler of fibrous material or the resistance which the filler offers to the flow of a testing fluid therethrough, as long as the rate at which the pneumatic testing fluid escapes at the testing station is affected by the wear upon a belt conveyor, such as the garniture belt 11 of the illustrated apparatus.

The transducer 29 can constitute a combination of a sensing unit of the type PR 6422 with a converter of the Type CON 010, both manufactured by Philips.

The pressure-voltage transducer 19 can be of the type AH 77 830 manufactured by the Firm Hundsbach, Federal Republic of Germany.

The signal correcting circuit 21 can include or constitute an operational amplifier of the type AD 544 manufactured by Analog Devices.

We claim:

1. A method of making a continuous body of fibrous material, particularly for subdivision into rod-shaped articles of predetermined length, comprising the steps of advancing a continuous tow of fibrous material along a predetermined path including transporting the tow by an endless belt the thickness of which decreases as a result of wear; gradually condensing the running tow in a predetermined portion of said path to thus convert the tow into a rod-like filler; measuring a characteristic of the filler and generating first signals denoting the measured characteristic; monitoring the thickness of the belt and generating second signals denoting the monitored thickness; and modifying said first signals as a function of said second signals.

2. The method of claim 1, wherein said measuring step includes measuring a characteristic of the filler in said predetermined portion of said path.

3. The method of claim 1, wherein said measuring step includes ascertaining the resistance which the filler offers to the flow of a gaseous fluid therethrough.

4. The method of claim 3, wherein said modifying step includes correcting said first signals to denote a higher resistance to the flow of gaseous fluid in response to decreasing thickness of the belt.

5. The method of claim 1, wherein the tow contains filamentary filter material.

6. The method of claim 5, further comprising the step of draping the filler into a web of wrapping material to convert the web and the filler into a continuous filter rod.

7. The method of claim 6, wherein said draping step is carried out in said portion of said path.

8. Apparatus for making a continuous body of fibrous material, particularly for subdivision into rod-shaped articles of predetermined length, comprising means for advancing a continuous tow of fibrous material along a predetermined path, including an endless belt the thickness of which decreases as a result of wear; means for gradually condensing the tow in a predetermined portion of said path to thus convert the tow into a rod-like filler; means for measuring a characteristic of the filler, including means for generating first signals denoting the measured characteristic; means for monitoring the thickness of said belt, including means for generating second signals denoting the monitored thickness of the belt; and means for modifying said first signals as a function of said second signals.

9. The apparatus of claim 8, wherein said measuring means includes means for measuring said characteristic of the filler in said portion of said path.

10. The apparatus of claim 8, wherein said belt includes a portion which advances the fibrous material along said portion of said path.

11. The apparatus of claim 8, wherein said measuring means includes means for measuring the resistance which the filler offers to the flow of a gaseous fluid therethrough.

12. The apparatus of claim 11, wherein said modifying means includes means for correcting said first signals to denote a higher resistance to the flow of a gaseous fluid in response to decreasing thickness of the belt.

13. The apparatus of claim 8, wherein said means for generating second signals includes a displacement measuring device.

14. The apparatus of claim 13, wherein said monitoring means further comprises a first guide at one side of said belt and a mobile second guide at the other side of said belt opposite said first guide, said second guide being arranged to move toward said first guide in response to decreasing thickness of the belt and said device being arranged to generate second signals which vary in response to movement of said second guide toward said first guide.

15. The apparatus of claim 14, wherein said monitoring means further comprises means for biasing said second guide toward said first guide.

16. The apparatus of claim 8, wherein said measuring means includes means for measuring the resistance which the filler offers to the flow of a gaseous fluid and said resistance measuring means includes a source of pressurized fluid, said condensing means having an inlet connected with said source and arranged to direct a stream of fluid against fibrous material in said portion of said path.

17. The apparatus of claim 8, for making a continuous filter rod, further comprising means for draping the filler into a web of wrapping material.

18. The apparatus of claim 17, wherein said draping means includes said belt.

19. The apparatus of claim 17, wherein said draping means includes said condensing means.

* * * * *